United States Patent [19]

Lonati

[11] Patent Number: 4,708,002

[45] Date of Patent: Nov. 24, 1987

[54] CIRCULAR KNITTING MACHINE INCORPORATING A DEVICE FOR SETTING TO WORK KNITTING CAMS, IN PARTICULAR FOR HOSE KNITTING

[75] Inventor: Francesco Lonati, Brescia, Italy

[73] Assignee: Lonati S.p.A., Brescia, Italy

[21] Appl. No.: 805,007

[22] Filed: Dec. 5, 1985

[30] Foreign Application Priority Data

Dec. 10, 1984 [IT] Italy ..... 23968 A/84

[51] Int. Cl.[4] ..... D04B 15/78

[52] U.S. Cl. ..... 66/40; 66/218

[58] Field of Search ..... 66/25, 40, 75.2, 218, 66/219

[56] References Cited

U.S. PATENT DOCUMENTS 2,827,780 3/1958 Mahler ..... 66/40
3,916,646 11/1975 Takigawa et al. ..... 66/219
4,222,247 9/1980 Hashimoto et al. ..... 66/218 X
4,526,017 7/1985 Shima ..... 66/75.2 X

FOREIGN PATENT DOCUMENTS 1204424 9/1970 United Kingdom ..... 66/25
1358381 7/1974 United Kingdom ..... 66/219
1368697 10/1974 United Kingdom ..... 66/219

*Primary Examiner*—Wm. Carter Reynolds
*Attorney, Agent, or Firm*—Guido Modiano; Albert Josif

[57] ABSTRACT

The device includes a slide movable in a substantially perpendicular direction to the axis of the needle cylinder and being rigidly associated with a knitting cam selectively engageable with the needle butts, and a step motor actuated by an electronic machine control. The step motor is connected to a drive cam which engages with a cam follower carried on the cited slide to produce a preset displacement of the knitting cam with respect to the needle cylinder on account of the knitting cam engaging selectively the needle butts.

6 Claims, 6 Drawing Figures

CIRCULAR KNITTING MACHINE INCORPORATING A DEVICE FOR SETTING TO WORK KNITTING CAMS, IN PARTICULAR FOR HOSE KNITTING

BACKGROUND OF THE INVENTION

This invention relates to a circular knitting machine incorporating a device for setting to work knitting cams, in particular for hose knitting.

Many particular knitting types are to be carried out on knitting machines and in particular hose knitting machines which are generally based on changing the number of the needles brought to knit and variation of the paths of the butts of such needles internally of the needle cylinder cam assemblies.

Knitting cams are provided for such variations which can be pushed in or inserted and withdrawn as required, of the needle cylinder cam assemblies so as to alter the path of the needle butts which are moved internally of the cam assemblies. These knitting cams can be pushed into two positions and the needles are provided some with long butts and some with short butts, such that by changing the pushed-in position, the number of the needles brought to knit is also changed.

Known are devices for pushing in the knitting cams which comprise generally a lever system driven by cams carried on the main drum, having the function of the machine control, and driving the various knitting cams which must be pushed in and withdrawn from the cam assemblies.

In practice the main drum carries on its outer surface a given number of elevations or drive cams which, through a lever system, drive the knitting cams in accordance with a knitting scheme set by these drive cams.

These devices have the disadvantage of being mechanically complicated owing to the need of providing several lay levers and drive cams on the main drum.

In particular the construction of the main drum is to be altered to adapt it for the knittings envisaged by the hose manufacturer, as well as a complex variety of drive cams to be assembled each time to the main drum.

Another drawback resulting from the high number of mechanical parts is that special attention is to be devoted to adjusting all the members during the machine tune-up.

In time, moreover, all these mechanical parts are subjected to wear and this cumbersome adjusting operation must be repeated periodically to take up any play.

SUMMARY OF THE INVENTION

It is the primary aim of this invention to provide a circular knitting machine incorporating a device for setting to work knitting cams which affords a great simplification of the overall machine mechanics thus eliminating all the drawbacks listed above.

Within this aim, it is an object of the invention to enable the machine to be controlled electronically as regards the operations described, thus obtaining the possibility of programming the machine in a more complete manner with respect to that afforded by the main drum.

This aim, and this and other objects which will be apparent hereinafter, are achieved by a circular knitting machine incorporating a device for setting to work knitting cams, in particular for hose knitting, comprising a slide movable in a substantially perpendicular direction to the needle cylinder axis and associated fixedly with a knitting cam selectively engageable with the needle butts, characterized in that it comprises a step motor actuated by an electronic machine control and connected to a drive cam engaging with a cam follower carried on said slide to cause said knitting cam to complete a set displacement movement with respect to said needle cylinder owing to the selective engagement of said knitting cam with said needle butts.

BRIEF DESCRIPTION OF THE DRAWINGS

Further features and advantages of this invention will become apparent from the description of a preferred but not exclusive embodiment of the machine incorporating the device according to the invention shown by way of illustration in the accompanying drawings where.

DESCRIPTION OF THE PREFERRED EMBODIMENTS

Figure 2:
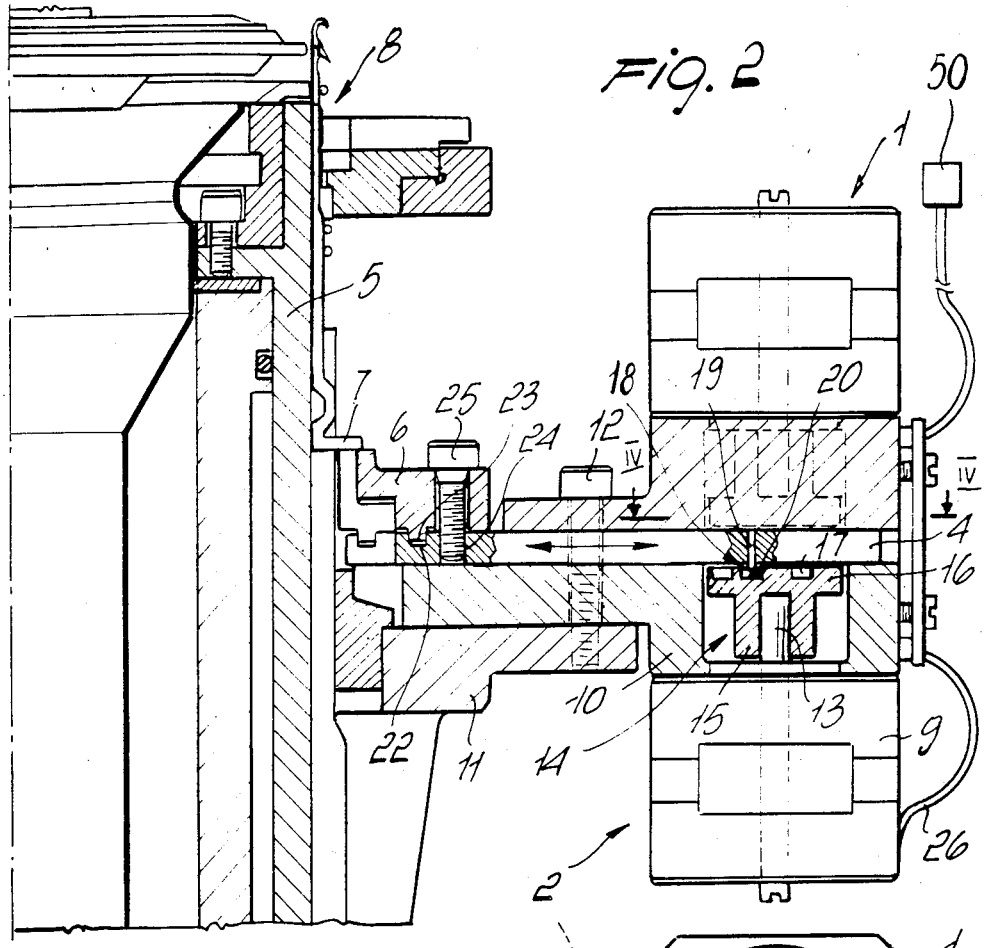
FIG. 2 is a sectional view of FIG. 1 taken along the line II—II.
Figure 1:
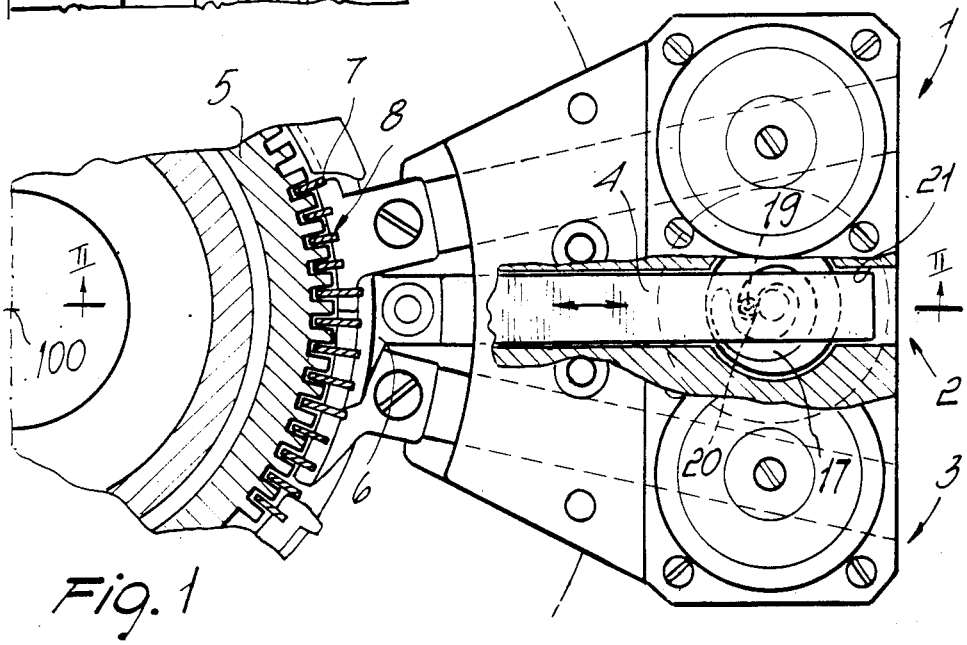
FIG. 1 is a top plan view of three devices according to the invention applied to the machine, of which only a portion of the needle cylinder is shown for simplicity.
Figure 4:
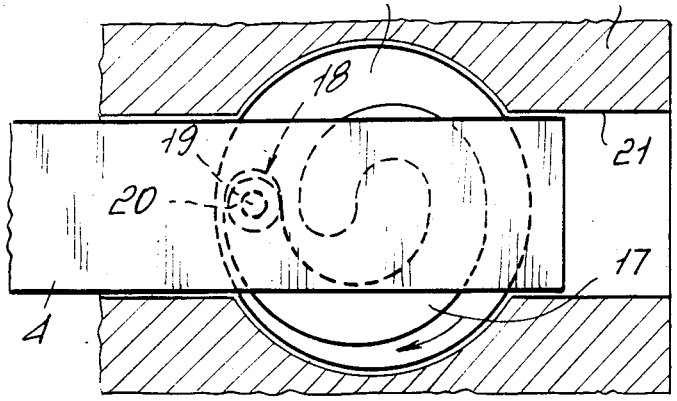
FIGS. 4, 5 and 6 are enlarged sections of part of FIG. 2 taken along the axis IV—IV showing the drive cam at different operating positions.
Figure 3:
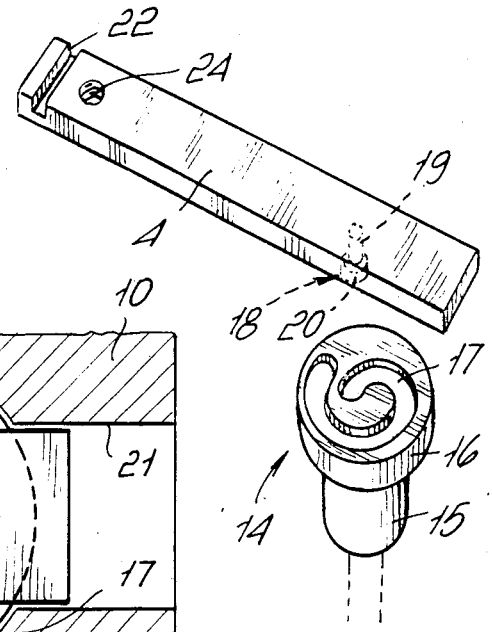
FIG. 3 is a perspective view showing the drive cam and the slide according to the invention.
Figure 5:
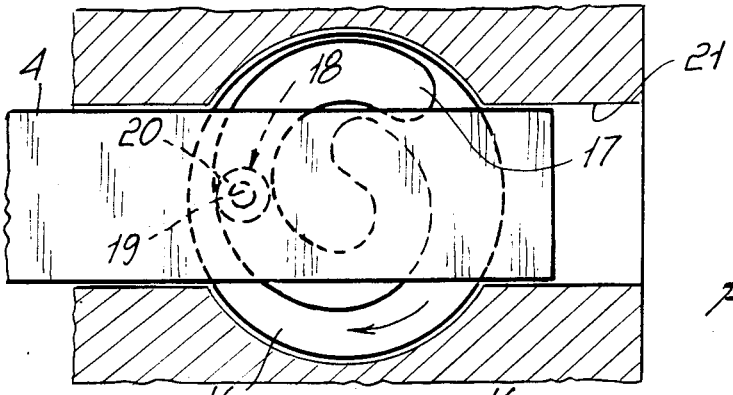

In FIGS. 1 and 2 there are shown three devices according to the invention, generally and respectively designated with the reference numerals 1, 2 and 3, carried on a single framework for driving three knitting cams which are usually mounted in a set on these machines; for simplicity, only the device 2 will be described it being understood that what is stated may also apply to the devices 1 and 3.

With reference to the drawing figures the device according to the invention comprises a slide 4, movable with a translatory motion in a substantially perpendicular direction to the axis of the needle cylinder 5 and rigidly associated with a knitting cam 6, selectively engageable with the butts 7 of the needles 8.

The device further comprises, according to the invention, a step motor 9 which is supported on a framework 10 rigidly associated with the load bearing structure 11 of the machine, for example by means of screws 12.

The step motor has transmission means in the form of an output shaft 13 with its axis substantially parallel to the needle cylinder axis, rigidly connected to a drive cam 14 substantially comprising a camshaft 15 and a disk 16 which are also component parts of the transmission means.

The opposed face of the disk 16, from the step motor, extends on a substantially perpendicular plane to the rotation axis of the output shaft 13, and carries a groove 17 with curvilinear or an offcentered path.

In the groove 17 there engages slidably a cam follower 18, rigidly associated with the slide 4, essentially comprised of a pin 19. To minimize friction and hence wear it is possible to provide on this pin a small roller 20 such that the cam follower cam roll along the groove 17. In this manner, the cam follower engages bilaterally with the drive cam. If one wishes to have the slide 4 advancement directly proportional to the rotation angle of the output shaft 13 one must provide for the groove 17 to be substantially a section of a spiral.

To prevent any misalignment of the slide 1, in its motion to and away from the needle cylinder, one should provide internally of the framework 10 a seat 21 which extends in a substantially perpendicular direction to the axis of the needle cylinder.

For completion of description it should be said that, since the device must be very accurate, to avoid possible loosening and hence play in the sliding direction of the slide, it is possible to provide the slide with a locating groove 22 wherein a dog 23 carried correspondingly on the knitting cam 6 engages and a threaded hole 24 wherein the fastening screw 25 which holds the knitting cam engages.

The step motor is actuated, through the wire 26 by an electronic machine control 50, such as a microprocessor programmed in accordance with the various knittings to be carried out on the machine.

The device according to this invention operates as follows.

Figure 6:
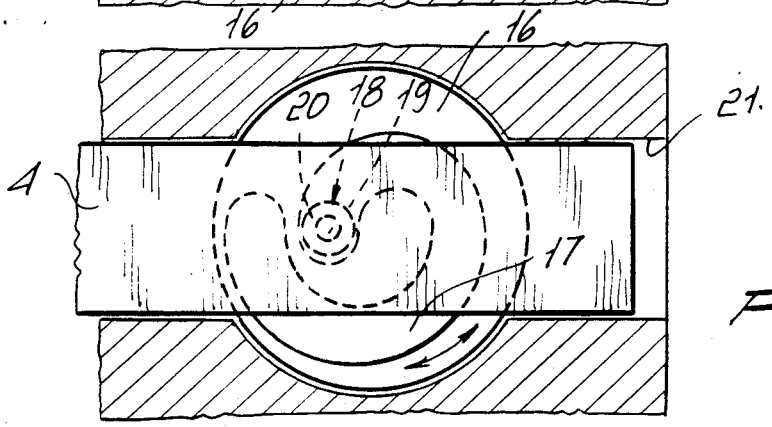

At the start of the knitting cycle the control 50 arranges for resetting the rotation of the drive cam by controlling the step motor to perform one complete backward revolution. The drive cam, on reaching the end of its revolution, which corresponds to the position depicted in FIG. 6, is blocked by the cam follower which is located at one end of the groove 17 and the step motor completes the rotation imparted thereto idly with respect to the drive cam. By providing different lengths for the needle butts, some of which having a radial extension greater than the other as visible in FIG. 1, it is possible to push the knitting cam into the cam assemblies such that it engages with just one of them, with some others, or with all of them.

For this purpose, the control 50 imposes a given rotation to the step motor with consequent set advancement of the slide to take the knitting cam to engage with a given number of needles which are to carry out the operation controlled by the knitting cam.

To control the precise time when the knitting cam is to be pushed in, the control member, such as a microprocessor, may be connected to an encoder which controls the needle cylinder rotation.

It has been found in practice that the machine incorporating the device of this invention fully achieves its set aim by obtaining a great simplification in the machine mechanics and a higher accuracy.

Another advantage, resulting from the higher accuracy, is that several positions of engagement can be provided for the drive cam, as against the two positions of engagement provided by known types due to the impossibility of achieving small constant displacements reliably with many lay levers.

With this there may be provided several lengths for the needle butts so as to increase the types of knittings which the machine can perform.

Another advantage is that there are no longer long times involved in adjustment during the machine tuning-up because everything can be controlled through the machine's electronic control.

A not least advantage, resulting from the fact that many lay levers have been eliminated, is that of reducing considerably the wear problems which required adjustment at regular intervals.

A further advantage is that of having freed the pushing in of the knitting cams from a mechanical type of control thus obtaining ease in adapting the knitting programs to the user's requirements.

The machine with the device herein is susceptible to many modifications and changes without departing from the scope of the inventive concept; furthermore, all the details are replaceable with technical equivalents thereof.

For simplicity of description this invention has been disclosed with reference to a device applied to the needle cylinder of a hose knitting circular machine, it being understood that the same device may be applied to any knitting machine whenever it is required that knitting cams be set to work with one or more positions of engagement of the cams with the needle butts.

In practicing the invention the materials used and the dimensions may be any ones contingent on requirements and the state of the art.

I claim:

1. In a circular knitting machine with a supporting structure, a needle cylinder having an axis of rotation, a plurality of needles with needle butts in cooperation with said needle cylinder, and knitting cams selectively engageable with the needle butts, a device for setting a knitting cam to work, comprising a slide member movable in a direction substantially perpendicular to said axis of rotation of the needle cylinder, said slide having one end portion thereof connected to said knitting cam, a step motor supported on said supporting structure, transmission means for transmitting a preset motion from said step motor to said slide, and an electronic machine control for controlling said step motor to cause said slide member to move said knitting cam thereon into a preset relative position with respect to said needle butts, wherein said transmission means comprise a rectilinear guide on said supporting structure and extending perpendicular to said axis of rotation of said needle cylinder for guiding said slide along a translatory motion path, a drive shaft of said step motor, a drive cam member in rigid rotatory relationship with said drive shaft and a cam follower member on said slide and in contact engagement with said drive cam and wherein at least one of said needle butts has a radial extension greater than the radial extension of said needle butts other than said at least one needle butt, said at least one needle butt being adapted to be selectively engaged by said knitting cam depending on the position into which said slide is selectively shifted by said step motor rotation.

2. A device according to claim 1, wherein said drive shaft extends substantially parallel to said axis of rotation of the needle cylinder and wherein said drive cam member has a disk-like body portion having a surface portion with a center concentric with said drive shaft, said surface portion being perpendicular to said drive shaft and parallel to and facing said slide and including a groove path extending along a curvilinear line eccentric with respect to said center and wherein said cam follower member comprises a pin fixed on said slide member and slidably engaging said groove path.

3. A device according to claim 2, wherein said groove path extends along a substantially spiral line.

4. A device according to claim 2, wherein said pin has a cam follower roller rotatably supported thereon and in slidable engagement with said groove path.

5. In a circular knitting machine with a supporting structure, a needle cylinder having an axis of rotation, a plurality of needles with needle butts in cooperation with said needle cylinder, and knitting cams selectively engageable with the needle butts, a device for setting a knitting cam to work, comprising a slide member movable in a direction substantially perpendicular to said axis of rotation of the needle cylinder, said slide having one end portion thereof connected with said knitting cam, a step motor supported on said supporting structure, transmission means for transmitting a preset motion from said step motor to said slide, and an electronic machine control for controlling said step motor to cause said slide member to move said knitting cam thereon into a preset relative position with respect to said needle butts, wherein said transmission means comprise a rectilinear guide on said supporting structure and extending perpendicular to said axis of rotation of said needle cylinder for guiding said slide along a translatory motion path, a drive shaft of said step motor and extending substantially parallel to said axis of rotation of the needle cylinder, a drive cam member in rigid rotatory relationship with said drive shaft and having a disk-like body portion having a surface portion with a center concentric with said drive shaft, said surface portion being perpendicular to said drive shaft and parallel and facing said slide and including a groove path extending along a curvilinear line eccentric with respect to said center and a cam follower member on said slide and comprising a pin fixed on said slide member and slidably engaging said groove path, wherein at least one of said needle butts has a radial extension greater than the radial extension of said needle butts other than said at least one needle butt, said at least one needle butt being adapted to be selectively engaged to said needle cam depending on the positions into which said slide is selectively shifted by said step motor rotation and in at least one position of said slide said at least one needle butt being in engagement with said knitting cam and said needle butts other than said at least one needle butt being out of reach of said knitting cam.

6. A device according to claim 5, wherein said groove path extends along a substantially spiral line.

* * * * *